US007353611B2

(12) United States Patent
Edwards et al.

(10) Patent No.: US 7,353,611 B2
(45) Date of Patent: Apr. 8, 2008

(54) BOW SIGHT ALIGNMENT TOOL

(76) Inventors: Michael W. Edwards, 2379 E. Evergreen Rd., Stanton, MI (US) 48888; David M. Bean, 6420 McBride Rd., Lakeview, MI (US) 48850

( * ) Notice: Subject to any disclaimer, the term of this patent is extended or adjusted under 35 U.S.C. 154(b) by 0 days.

(21) Appl. No.: 11/158,133

(22) Filed: Jun. 21, 2005

(65) Prior Publication Data

US 2005/0278965 A1 Dec. 22, 2005

Related U.S. Application Data

(60) Provisional application No. 60/652,536, filed on Feb. 14, 2005, provisional application No. 60/581,443, filed on Jun. 21, 2004.

(51) Int. Cl.
*F41G 1/467* (2006.01)

(52) U.S. Cl. ..... 33/265; 124/87

(58) Field of Classification Search ..... 33/265; 124/86–88

See application file for complete search history.

(56) References Cited

U.S. PATENT DOCUMENTS

| | | | | | |
|---|---|---|---|---|---|
| 1,961,517 | A | * | 6/1934 | Klopsteg | 33/265 |
| 2,664,078 | A | * | 12/1953 | Irwin | 33/265 |
| 3,574,944 | A | * | 4/1971 | Reynolds | 33/265 |
| 4,382,339 | A | | 5/1983 | Saunders | |
| 4,594,786 | A | | 6/1986 | Rezmer | |
| 4,596,229 | A | | 6/1986 | Bell | |
| 4,788,961 | A | * | 12/1988 | Toth | 33/265 |
| 4,911,137 | A | | 3/1990 | Troncoso | |
| 4,974,576 | A | | 12/1990 | Morey et al. | |
| 5,060,627 | A | | 10/1991 | Fenchel | |
| 5,099,819 | A | * | 3/1992 | Simonds et al. | 124/88 |
| 5,161,310 | A | * | 11/1992 | Stoot | 33/265 |
| 5,175,937 | A | | 1/1993 | Emerson, III | |
| 5,201,304 | A | * | 4/1993 | Rezmer | 124/87 |
| 5,231,971 | A | | 8/1993 | York et al. | |
| 5,255,440 | A | | 10/1993 | Rogers | |
| 5,344,110 | A | | 9/1994 | Scarpa | |
| 5,353,511 | A | | 10/1994 | Boll et al. | |
| 5,367,780 | A | * | 11/1994 | Savage | 33/265 |
| 5,414,936 | A | * | 5/1995 | Sappington | 33/265 |
| 5,481,807 | A | | 1/1996 | Ploot | |
| 5,983,879 | A | | 11/1999 | Gifford | |
| 6,098,608 | A | * | 8/2000 | Oshlick | 124/87 |
| 6,134,793 | A | | 10/2000 | Sauers | |
| 6,526,666 | B1 | * | 3/2003 | Lastinger, Jr. | 33/265 |
| 6,637,122 | B2 | | 10/2003 | Henry | |
| 6,868,614 | B2 | * | 3/2005 | Floied et al. | 33/265 |
| 2004/0007224 | A1 | * | 1/2004 | Brown, Jr. | 124/87 |

* cited by examiner

*Primary Examiner*—Yaritza Guadalupe-McCall
(74) *Attorney, Agent, or Firm*—Price, Heneveld, Cooper, DeWitt & Litton, LLP

(57) ABSTRACT

An alignment tool of the present invention is provided for aligning a sight for a bow. The alignment tool may comprise a sight reference plate comprising reference markings, and a support mechanism attached to the sight reference plate for releasably attaching the sight reference plate to the bow behind the sight such that the sight may be adjusted relative to the reference markings on the sight reference plate. The support mechanism may comprise a peg for releasable attachment to a stabilizer hole of the bow. The alignment tool may further comprise an additional structure for enabling the adjustment of the nocks, rest, and tiller of the bow.

23 Claims, 3 Drawing Sheets

BOW SIGHT ALIGNMENT TOOL

CROSS-REFERENCE TO RELATED APPLICATIONS

This application claims priority under 35 U.S.C. 119(e) to the filing dates of U.S. Provisional Patent Application No. 60/581,443 filed on Jun. 21, 2004, and U.S. Provisional Patent Application No. 60/652,536 filed on Feb. 14, 2005, the entire disclosures of which are incorporated herein by reference.

BACKGROUND OF THE INVENTION

The present invention generally relates to an archery tool, and more specifically relates to a tool for aligning the sight of a bow.

It is commonplace for archers to utilize a sight on their bow to enable accurate aiming to achieve the goal of shooting an arrow at the desired location of a target. Archers may spend many hours carefully positioning their sight markers to improve their accuracy. The positioning of sight markers is not only particular to the archer, but also to the bow and the various components of the bow. In addition, sights may be adjusted for various distances and may be shifted horizontally to account for the angle at which the bow may be typically held by that particular archer.

Unfortunately, after many hours of careful alignment of the bow sight, the sight may accidentally be bumped or otherwise moved relative to the bow such that an archer must go through the whole process of re-aligning their bow sight. Accordingly, there is a need for a tool that allows quick, easy, and accurate re-alignment of a bow sight.

SUMMARY OF THE INVENTION

It is an aspect of the present invention to provide a tool for aligning the sight of a bow consistently and accurately. The tool provides a mechanism for accurately and consistently positioning a sight reference plate relative to the bow and bow sight such that markings on the reference plate may be used as a reference for aligning the sight.

According to one aspect of the present invention, an alignment tool is provided for aligning a sight for a bow, where the alignment tool comprises: a sight reference plate comprising reference markings and a support mechanism attached to the sight reference plate for releasably attaching the sight reference plate to the bow behind the sight such that the sight may be adjusted relative to the reference markings on the sight reference plate.

According to another aspect of the present invention, an alignment tool is provided for aligning a sight for a bow, where the alignment tool comprises: a sight alignment device and a support mechanism attached to the sight alignment device to support the sight alignment device relative to the bow, the support mechanism comprising a brace bar including a peg for releasable attachment to a stabilizer hole in a bow riser of the bow.

According to another aspect of the present invention, a tool is provided for use in aligning components of a bow, where the tool comprises: a support mechanism for supporting alignment devices on the bow, the support mechanism comprising a brace bar removably attached to the bow, a bracket attached to the brace bar; a square bar rod adjustably attached to the bracket in substantially perpendicular relation, the square bar rod having an alignment hole; and a laser alignment mechanism mounted to the support mechanism for emitting a laser beam through the alignment hole of the square bar rod when the square bar rod is in substantially perpendicular relation to the bracket.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
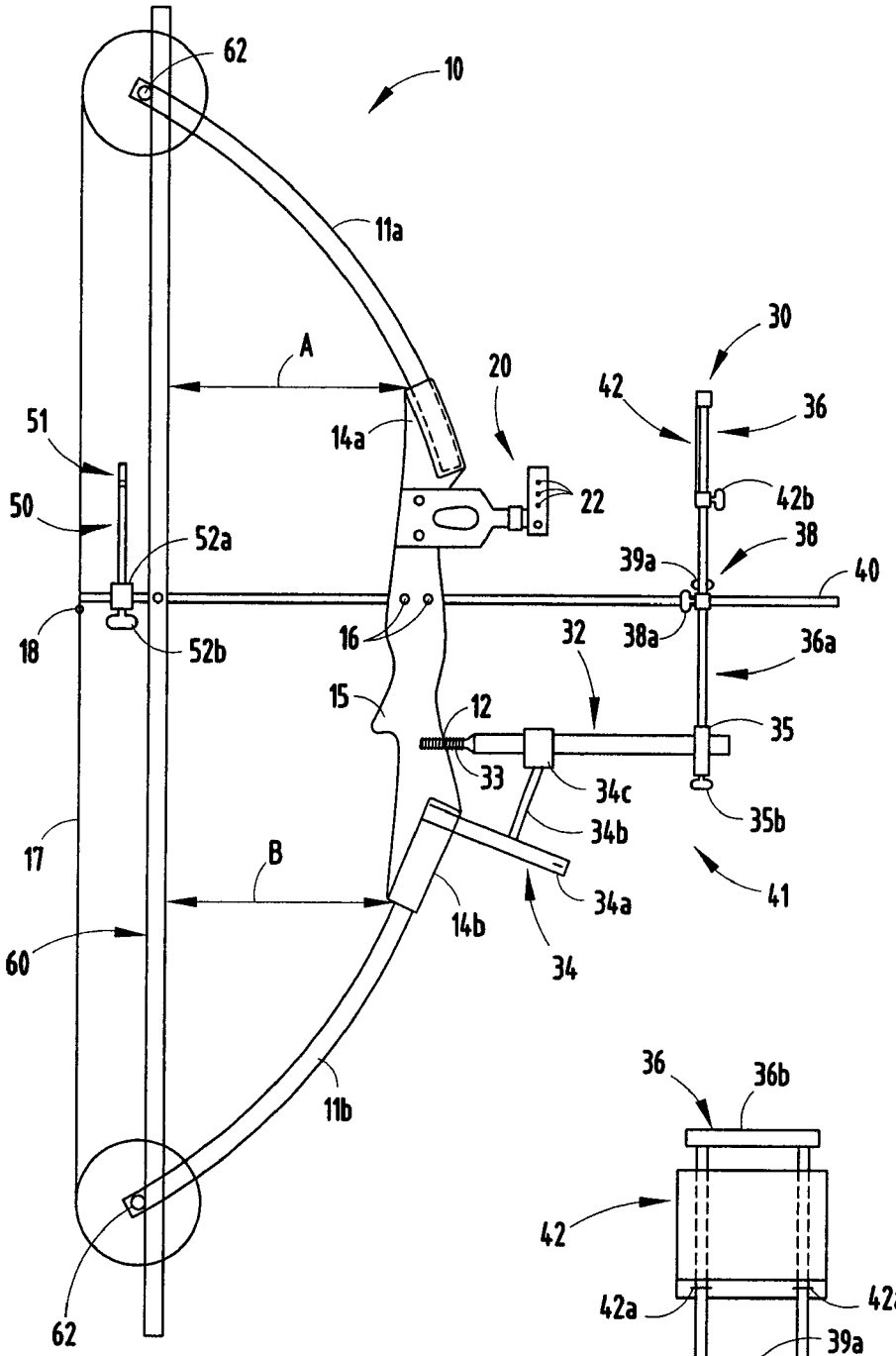
FIG. 1 is an elevational side view of a bow having attached thereto a sight pin alignment tool of a first embodiment of the present invention.

Reference will now be made in detail to the present preferred embodiments of the invention, examples of which are illustrated in the accompanying drawings. Wherever possible, the same reference numerals will be used throughout the drawings to refer to the same or like parts.

For purposes of description herein, the terms "upper," "lower," "right," "left," "rear," "front," "vertical," "horizontal," "top," "bottom," and derivatives thereof shall relate to the invention as viewed by a person looking directly at the bow and sight alignment tool when the bow is held upright in a proper shooting position. However, it is to be understood that the invention may assume various alternative orientations, except where expressly specified to the contrary. It is also to be understood that the specific device illustrated in the attached drawings and described in the following specification is simply an exemplary embodiment of the inventive concepts defined herein. Hence, specific dimensions, proportions, and other physical characteristics relating to the embodiment disclosed herein are not to be considered as limiting, unless expressly stated otherwise.

Referring first to FIG. 1, a typical bow 10 is illustrated. As shown, bow 10 includes a bow riser 15 including a top limb pocket 14*a* for receiving a top limb 11*a* and a bottom limb pocket 14*b* for receiving a bottom limb 11*b*. The bow further includes a string 17 extending between the distal ends of limbs 11*a* and 11*b* by conventional means such as pulleys or the like. Most bow risers 15 include a stabilizer hole 12 opening towards the front of the bow. The bow riser 15 may further include holes 16 for mounting a rest (not shown). The bow may further include one or more nocks 18 mounted on the bow string 17.

Figure 3:
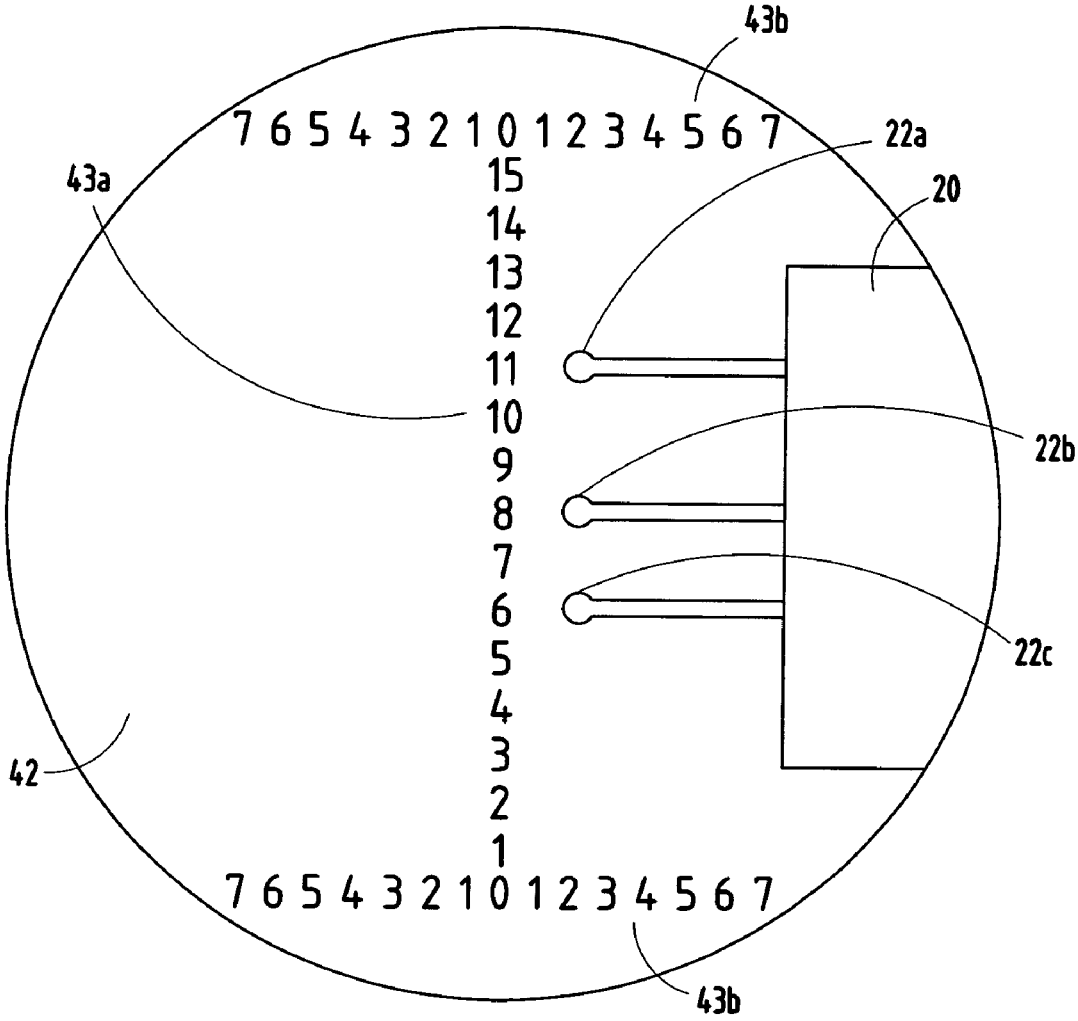
FIG. 3 is a perspective view showing a user's view through the peep of the bow of the sight pins and the sight reference plate of the bow sight pin alignment tool of the present invention.

Also shown in FIG. 1 is a sight 20 mounted to bow riser 15. As best shown in FIG. 3, a sight 20 may include a plurality of horizontally extending sight pins 22*a*, 22*b* and 22*c* (collectively shown as 22 in FIGS. 1 and 4) each corresponding to different distances to the target. It will be appreciated, however, that sights come in various forms with various mechanisms for adjustment, and thus the present invention is not limited to use with those sights that include adjustable sight pins.

Figure 2:
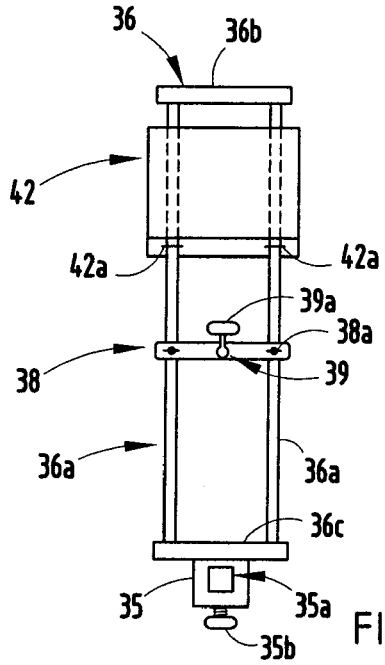
FIG. 2 is a front elevational view of the bow sight alignment tool of the first embodiment of the present invention.

An example of the bow sight alignment tool 30 of the present invention is shown in FIGS. 1 and 2. In general, the bow sight alignment tool includes a sight reference plate 42 comprising reference markings 43*a* and 43*b* (FIG. 3) and a support mechanism 41 attached to sight reference plate 42 for releasably attaching sight reference plate 42 to the bow behind sight 20 such that sight 20 may be adjusted relative to reference markings 43*a* and 43*b*.

Support mechanism 41 may include a brace bar 32 having a peg 33 at one end. Peg 33 may be sized and shaped to be inserted into stabilizer hole 12 of bow riser 15. Peg 33 may be threaded if stabilizer hole 12 includes mating threads. As shown in FIGS. 1 and 2, brace bar 32 preferably has a square or other non-circular cross-sectional profile for the reasons discussed further below.

Support mechanism 41 may further include an optional limb pocket clamp 34 including a clamp portion 34*a* that clamps around the lower limb pocket 14*b* of bow riser 15. Limb pocket clamp 34 further includes an arm 34*b* extending from clamp portion 34*a* towards a sliding nut 34*c* that includes a square hole for receiving brace bar 32. In this manner, limb pocket clamp 34 may assist in holding brace bar 32 in the proper orientation with respect to the bow as described further below. It will be appreciated, however, that limb pocket clamp 34 is merely an optional component of the bow sight alignment tool as the brace bar 32 may otherwise provide a sufficiently stable mounting mechanism for the remaining portions of the tool 30.

In addition, support mechanism 41 may include a sight gauge bracket 36. Sight gauge bracket 36 includes one or more vertically extending rods 36*a* which extend substantially parallel to one another and are joined at the top and bottom by horizontal members 36*b* and 36*c*. At the bottom portion of horizontal member 36*c* is provided a nut 35 having a square brace bar hole 35*a* for slidably receiving brace bar 32. A set screw 35*b* may be provided for releasably securing the sight gauge bracket 36 such that it extends vertically and substantially perpendicularly upward from brace bar 32. Thus, by making brace bar 32 with a non-circular, cross-sectional profile, sight gauge bracket 36 will not rotate about the longitudinal axis of brace bar 32.

Sight reference plate 42 may include a pair of holes 42*a* for slidably receiving vertical rods 36*a* of sight gauge bracket 36. As shown in FIG. 1, set screws 42*b* may be provided for releasably securing sight reference plate 42 relative to sight gauge bracket 36. Thus, sight reference plate 42 may be slid upward or downward on sight gauge bracket 36 and secured in place in an appropriate position relative to sight 20 of bow 10 as further described below.

The bow sight alignment tool 30 may further include a sliding square bar 38 which may include a pair of holes for slidably receiving vertical rods 36*a* of sight gauge bracket 36. Set screws 38*a* may be provided for securing the position of sliding square bar 38. Sliding square bar 38 may further include a square bar rod hole 39 and the corresponding set screw 39*a* for receiving a square bar rod 40. Square bar rod 38 may have a cross section of any shape. As discussed further below, the square bar rod 40 may extend rearward for optional mounting of a sliding peep 50.

The sliding peep 50 includes a peep hole 51 and a nut 52*a*, which includes a hole for receiving square bar rod 40 and a set screw 52*b* for securing the sliding peep 50 in place.

Having generally described the components of both the bow and the sight alignment tool, the various operations for aligning the bow sight are described further below.

To use the alignment tool of the present invention, brace bar 32 is mounted to bow riser 15 by inserting peg 33 of brace bar 32 into stabilizer hole 12 of riser 15. Limb pocket clamp 34 may then be clamped on lower limb pocket 14 of riser 15. This helps to square the sight alignment tool to the riser. Next, the sight gauge bracket 36 is slid onto and secured to brace bar 32 so as to extend vertically upward. Next, square bar rod 40 is secured to sliding square bar 38 by inserting the square bar rod 40 through hole 39 and tightening the set screw 39*a* such that the end of square bar rod 40 extends rearward to bow string 17. The height of sliding square bar 38 is then adjusted on the sight gauge bracket 38 such that square bar rod 40 is aligned with the center of rest mounting holes 16 in bow riser 15. At this point, set screws 38*b* are tightened to secure this position of square bar rod 40. Next, one would slide sliding peep 50 onto the end of square bar rod 40 and align peep hole 51 with bow string 17. While looking through peep hole 51, one then adjusts the position of sight reference plate 42 in line with the top sight pin 22*a*. The height of sight reference plate 42 may then be recorded by marking the top or bottom of the plate relative to the vertical rods 36*a* of sight gauge bracket 36. At this point, one would be ready to adjust the positioning of the lower sight pins 22*b* and 22*c*.

As best shown in FIG. 3, which shows the view a person would see while looking through peep hole 51, reference plate 42 includes a vertical scale 43*a* and one or more horizontal scales 43*b*. At a time when the sight pins 22*a*, 22*b* and 22*c* are in their desired positions, the user may either record the numbers along the scales 43*a* and 43*b* at which these pins are positioned or may place markings on the sight reference plate 42 corresponding to the positions of the sight pins 22*a*-22*c* when properly positioned. In this manner, if the sight pins become misaligned, one may simply utilize the sight alignment tool 30 to reposition the sight and sight pins to the position where they should be when accurately aligned using sight reference plate 42 as a reference.

Although the present invention has been shown and described with respect to a bow sight having sight pins, the present invention may also be used to adjust various other forms of bow sights.

In addition to enabling the realignment of a bow sight, the inventive tool 30 may be used to set the nock point and rest. With the apparatus set up as described above, the top nock 18 may be slid along bow string 17 until it touches the bottom of square bar rod 40. Subsequently, the rest (not shown) is mounted to bow riser 15 via rest mounting holes 16 and is adjusted upward until it touches the bottom of square bar rod 40. In this manner, the rest and the top nock may be accurately and consistently positioned relative to the bow and the bow sight 20.

Tool 30 may additionally be utilized for mounting a new sight 20 to bow 10. With the tool 30 mounted to the bow as discussed above and shown in FIG. 1, sight reference plate 42 may be adjusted to scale according to a chart of axle length and draw length. Sliding peep 50 may also be adjusted to scale on chart according to axle length and draw length. Then, a new sight 20 may be mounted to bow riser 15 using the mounting holes in the riser. The sight 20 may then be adjusted to the scale on sight reference plate 42 using peep hole 51 of swinging peep 50 and scaled on sight reference plate 42.

The inventive sight alignment tool may also be used to check and set the tiller of the bow. The tool 30 may be set up as discussed above with or without sight reference plate 42. Then, sliding peep 50 may be swung out to the side to be used for mounting a tiller gauge bar 60. Tiller gauge bar 60 is slid into the gauge off-axle pins 62 of bow 10. One would then measure the distance A from the rear edge of the tiller gauge bar 60 to the top of top limb pocket 14*a*. Similarly, distance B is measured from the rear edge of tiller gauge bar 60 to the bottom of bottom limb pocket 14*b*. The limb bolts (not shown) that hold the limbs 11*a* and 11*b* in limb pockets 14*a* and 14*b* may then be adjusted until distances A and B are equal.

Figure 4:
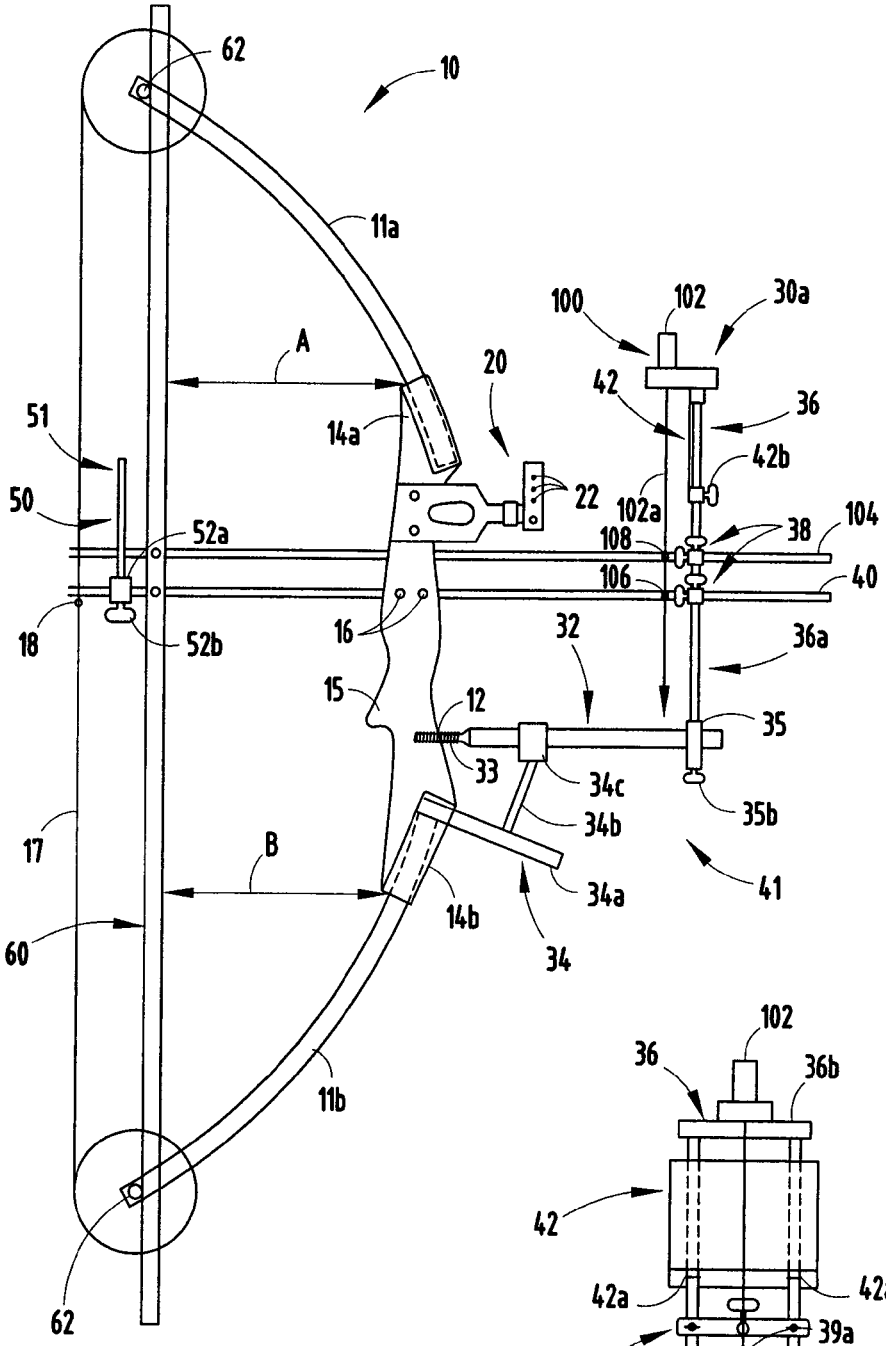
FIG. 4 is an elevational side view of a bow having attached thereto a sight pin alignment tool of a second embodiment of the present invention.
Figure 5:
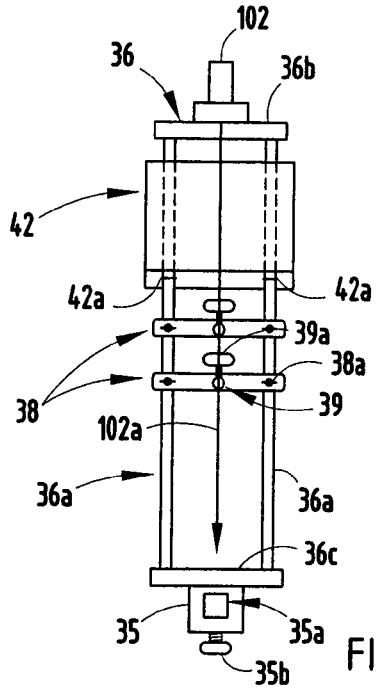
FIG. 5 is a front elevational view of the bow sight alignment tool of the second embodiment of the present invention.

A second embodiment of the present invention is shown in FIGS. 4 and 5. The second embodiment is similar to the first embodiment with the exception that the second embodiment further includes a laser alignment mechanism 100 for ensuring that the bow sight alignment tool 30*a* is properly oriented and positioned relative to bow 10. Laser alignment mechanism 100 includes a laser 102, a second square bar rod 104 that mounts in parallel to the first square bar rod 40, and a pair of alignment holes 106 and 108 through square bar rods 40 and 104, respectively. Second square bar rod 104 may be secured to vertical rods 36*a* in the same manner as first square bar rod 40, namely, using a sliding square bar 38. Alignment holes 106 and 108 of square bar rods 40 and 104 are equally sized and spaced relative to one another and are configured to be aligned with each other and with a laser beam 102*a* emitted from laser 102 when the alignment tool is squarely and properly positioned relative to bow 10 with sight gauge bracket 36 aligned in parallel with bow string 17 and perpendicular to first and second square bar rods 40 and 104. In this manner, alignment tool 30*a* may be mounted to bow 10 and may be adjusted until the laser beam 102*a* projects simultaneously through both alignment holes 106 and 108.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. An alignment tool for aligning a sight for a bow, said alignment tool comprising:

a sight reference plate comprising reference markings; and a support mechanism attached to said sight reference plate for releasably attaching said sight reference plate to the bow behind the sight such that the sight may be adjusted relative to said reference markings on said sight reference plate.

2. The alignment tool of claim 1, wherein said support mechanism comprises a peg for releasable attachment to a stabilizer hole of the bow.

3. The alignment tool of claim 2, wherein said peg is threaded for threading into the stabilizer hole of the bow.

4. The alignment tool of claim 1, wherein said support mechanism comprises a horizontally extending brace bar and a vertically extending sight gauge bracket attached to said sight reference plate and to said brace bar.

5. The alignment tool of claim 4, wherein said sight gauge bracket is slidably mounted to said brace bar so as to be slidable along the length of said brace bar such that said sight reference plate may be adjusted forward and backward relative to the sight.

6. The alignment tool of claim 5, wherein said sight reference plate is slidably mounted to said sight gauge bracket such that said sight reference plate may be adjusted vertically relative to the sight.

7. The alignment tool of claim 4, wherein said sight reference plate is slidably mounted to said sight gauge bracket such that said sight reference plate may be adjusted vertically relative to the sight.

8. The alignment tool of claim 4, wherein said sight gauge bracket comprises a pair of vertical rods extending parallel to one another in a spaced relation, and wherein said sight reference plate comprises a pair of corresponding holes for slidably receiving said vertical rods.

9. The alignment tool of claim 4 and further comprising a square bar rod extending horizontally from said sight gauge bracket to a bow string of the bow.

10. The alignment tool of claim 9 and further comprising a sliding square bar mounted on said sight gauge bracket such that said sliding square bar may be vertically adjusted along the sight gauge bracket, said square bar rod being mounted to said sliding square bar.

11. The alignment tool of claim 4, wherein said support mechanism further comprises a limb pocket clamp for clamping to a limb pocket of the bow, the limb pocket clamp including an arm that extends to said brace bar for assisting in holding said support mechanism in the proper orientation relative to the bow.

12. The alignment tool of claim 1 and further comprising a square bar rod extending horizontally from said support mechanism to a bow string of the bow.

13. The alignment tool of claim 12 and further comprising a sliding peep slidably mounted to said square bar rod.

14. The alignment tool of claim 12, wherein said square bar rod extends to the bow string of the bow to thereby enable a nock to be set on the bow string at a point corresponding to a bottom edge of said square bar rod.

15. The alignment tool of claim 12, wherein said square bar rod extends past a riser of the bow at a location where a rest of the bow may be adjusted by moving the rest up into engagement with a bottom edge of said square bar rod.

16. The alignment tool of claim 12 and further comprising a tiller gauge bar mounted on said square bar rod for engaging pins of the bow to enable adjustment of the tiller of the bow.

17. The alignment tool of claim 1 and further comprising a laser alignment mechanism mounted to said support mechanism, wherein said laser alignment mechanism assists in aligning said support mechanism relative to the bow.

18. The alignment tool of claim 17 and further comprising first and second square bar rods extending horizontally and in parallel from said support mechanism to a bow string of the bow, wherein said first and second square bar rods each include an alignment hole that are both aligned with one another and a laser beam emitted from said laser alignment mechanism when said support mechanism is properly oriented relative to the bow.

19. An alignment tool for aligning a sight for a bow, said alignment tool comprising:

a sight alignment device; and a support mechanism attached to said sight alignment device to support said sight alignment device on the bow relative to the sight, said support mechanism comprising a brace bar including a peg for releasable attachment to a stabilizer hole in a bow riser of the bow, wherein said peg is directly formed on said brace bar.

20. The alignment tool of claim 19, wherein said sight alignment device is a sight reference plate for positioning behind the sight.

21. A tool for use in aligning components of a bow, said tool comprising:

a support mechanism for supporting alignment devices on the bow, said support mechanism comprising a brace bar removably attached to the bow, a bracket attached to said brace bar;

a square bar rod adjustably attached to said bracket in substantially perpendicular relation, said square bar rod having an alignment hole; and a laser alignment mechanism mounted to said support mechanism for emitting a laser beam through said alignment hole of said square bar rod when said square bar rod is in substantially perpendicular relation to said bracket.

22. The tool of claim 21 and further comprising a second square bar rod adjustably attached to said bracket in substantially perpendicular relation, said second square bar rod having an alignment hole that is aligned with the laser beam and the alignment hole of the other square bar rod when both said square bar rods are aligned substantially perpendicular to said bracket.

23. The tool of claim 21 and further comprising a sight reference plate attached to said bracket, for use in aligning a sight mounted to the bow.

* * * * *